United States Patent [19]

Kariya

[11] 3,972,929

[45] Aug. 3, 1976

[54] ALICYCLIC AMINO COMPOUNDS AND THEIR PRODUCTION

[75] Inventor: Noboru Kariya, Sakai, Japan

[73] Assignee: Nard Institute, Ltd., Japan

[22] Filed: Oct. 10, 1973

[21] Appl. No.: 405,162

[30] Foreign Application Priority Data

Oct. 11, 1972 Japan ..... 47-101702

[52] U.S. Cl. ..... 260/563 P; 260/570.5 R

[51] Int. Cl.[2] ..... C07C 87/40; C07C 87/28

[58] Field of Search ..... 260/563 P, 570.5 R

[56] References Cited

UNITED STATES PATENTS

| | | | |
|---|---|---|---|
| 2,635,979 | 4/1953 | Lidov | 260/563 P X |
| 2,843,587 | 7/1958 | de Benneville | 260/563 P X |
| 2,894,987 | 7/1959 | Stein et al. | 260/563 P |
| 3,231,595 | 1/1966 | Brotherton et al. | 260/563 P X |
| 3,505,402 | 4/1970 | Raff et al. | 260/563 P |

*Primary Examiner*—Paul F. Shaver

*Attorney, Agent, or Firm*—Wenderoth, Lind & Ponack

[57] ABSTRACT

An alicyclic amino compound of the general formula:

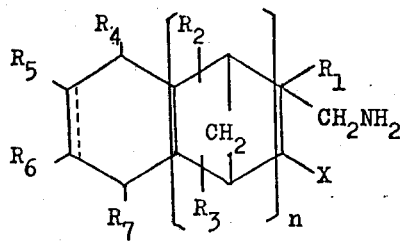

wherein $R_1$, $R_2$, $R_3$, $R_4$, $R_5$, $R_6$ and $R_7$ are each hydrogen, alkyl having 1 to 6 carbon atoms or phenyl; X is each hydrogen, alkyl having 1 to 6 carbon atoms or aminomethyl; *n* is an integer of 1 to 3; double bond may be present between the positions indicated by a dotted line, and their production.

6 Claims, No Drawings

ALICYCLIC AMINO COMPOUNDS AND THEIR PRODUCTION

The present invention relates to novel alicyclic amino compounds and their production.

As already known, a higher fatty amine, which is obtained by cyanation and then reduction of a higher fatty acid is generally used as a raw material for a cationic surface active agent. However, a higher fatty acid is naturally utilized for food and it is not desirable to utilize for industrial use, considering the unfavorable food situation in the world. Further, a higher fatty amine does not have a sufficient affinity with other materials when used as a cationic surface active agent. Besides, an aminomethyl derivative of natural rosin which is an alicyclic carboxylic acid is also utilized as a cationic surface active agent and is superior to the said higher fatty amine in various properties and characteristics. However rosin is also naturally occurring and its supply is not stable.

A main object of the present invention is to provide a novel alicyclic amino compound having properties and characteristics required for a cationic surface active agent and being superior to those of a higher fatty amine.

Another object of the present invention is to provide a process for manufacturing the same from abundant but unutilized materials such as thermal cracking products of petroleum naphtha or coal(e.g. dicyclopentadiene(DCPD) or its analogous compound).

These and other advantages and objects of the present invention will be apparent from the following descriptions.

The alicyclic amino compound of the present invention has the following chemical structure:

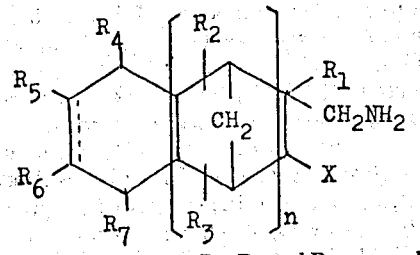

[I]

wherein $R_1$, $R_2$, $R_3$, $R_4$, $R_5$, $R_6$ and $R_7$ are each hydrogen alkyl having 1 to 6 carbon atoms or phenyl; X is each hydrogen, alkyl having 1 to 6 carbon atoms or aminomethyl; *n* is an integer of 1 to 2; double bond may be present between the positions indicated by a dotted line.

The alicyclic amino compound [I] of the present invention is obtained by hydrogenating the following alicyclic cyano compound of the general formula:

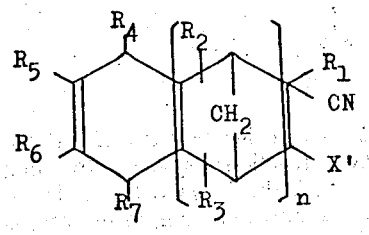

[II]

wherein $R_1$, $R_2$, $R_3$, $R_4$, $R_5$, $R_6$, $R_7$ and *n* are each as defined above; X′ is each hydrogen, alkyl having 1 to 6 carbon atoms, aminomethyl or cyano.

The starting compound [II] is unknown and the ring skeleton can be further illustrated as follows.

n = 1

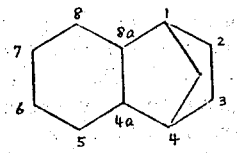

[II-1]

n = 2

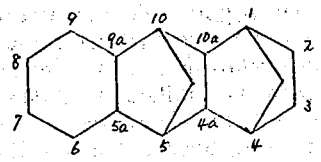

[II-2]

n = 3

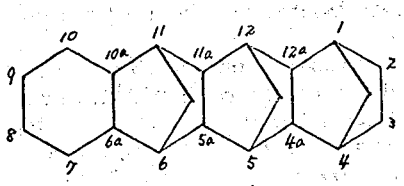

[II-3]

The starting compound [II] corresponding to the ring skeleton of [II-1], [II-2] and [II-3] can be respectively prepared by reacting 1,3-butadiene or its alkyl substituted derivative such as 2-methyl-1,3-butadiene (isoprene), 1,3-pentadiene (piperilene), etc. with each 5-cyanonorbornene or the adduct [II-2'] or [II-3'] of α,β-unsaturated cyano compound and cyclopentadiene(CPD).

The adducts [II-2'] and [II-3'] can be prepared by reacting one mole of α,β-unsaturated cyano compound such as acrylonitrile, methacrylonitrile, maleonitrile, etc. with two or three moles of CPD or its alkyl substituted derivative, though DCPD is industrially applied in place of CPD. For example, when a mixture of acrylonitrile and DCPD is heated at 170°–200°C, a first step addition reaction proceeds rapidly to form 5-cyanobicyclo[2,2,1]heptene-2 (i.e. 2-cyanonorbornene) which is an equimolar adduct of acrylonitrile and CPD, having a ring skeleton of

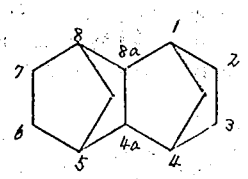

[II-2']

The adduct [II-2'] is further reacted with CPD that is present in the reaction system to prepare 1,2,3,4,4a,5,8,8a-octahydro-2-cyano-1,4-methano-5,8-methanonaphthalene corresponding to the ring skeleton of

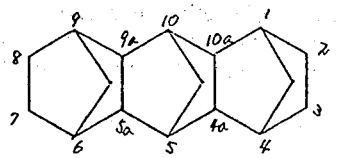

[II-3']

As apparent from the above descriptions, the starting compound [II] is prepared as a mixed state of the compound [II-1], [II-2] and [II-3]. These compounds can be subjected to hydrogenation of the present invention without any obstruction and they are useful for a cationic surface active agent even as a mixed state. While, if each isolated object compound[I] is desirable, they may be separated by fractional distillation employing the difference of boiling point before or after hydrogenation of the present invention. However, the starting compounds [II] wherein $n$ is 2 or 3 especially X' is cyano are difficult to be purified since they have a higher boiling point. Accordingly, they may be obtained as residue after fractional distillation. Therefore, the balance of hydrophobic and hydrophilic (HLB) can be easily controlled in the present invention by adjusting the number distribution of n in the starting compound [II].

It is further apparent from the above descriptions that higher adducts of α,β-unsaturated nitrile and CPD may be produced as by-products and the compound contaminated with higher adducts may also be utilized for a cationic surface active agent. However, if it is desirable to obtain the starting compound[II] in high yield, it is recommended to conduct the addition reaction at 180°–200°C and to complete the reaction within 4–8 hours.

The hydrogenation reaction of the present invention can be properly selected from various well known processes that are commonly applied for the reduction of cyano group. Cyano group(s) of the starting compound[II] are easily converted to aminomethyl group(s) by hydrogenation. Refering to a double bond between carbon-carbon atoms, it may be simultaneously hydrogenated or not according to the hydrogenation condition. Generally, the double bond of cyclohexene ring is sometimes hydrogenated and sometimes unhydrogenated.

Suitable hydrogenation reactions include, for example, catalytic reduction; electrolytic reduction; hydrogenation reaction in the presence of metallic sodium and an organic solvent such as ethanol, benzene, toluene, etc.; hydrogenation reaction with sodium hydroxide in the presence of nickel, sodium hypophosphite and hydrated ethanol; hydrogenation reaction with lithium aluminum hydride or sodium boron hydride; hydrogenation reaction in the presence of chromium acetate, and the like.

Among the above mentioned hydrogenation reactions, the catalytic reduction is most preferably applied for the starting compound[II] in the present invention. Therefore, the catalytic reduction is further disclosed in details as follows. The said reduction can be carried out in the liquid phase or gaseous phase under an atmospheric pressure or an elevated pressure. Catalysts utilized herein include various well known reductive catalysts such as heavy metal e.g. platinium, palladium, nickel, cobalt, cupper, iron, etc.; an activated said heavy metal e.g., Raney-nickel, Raney-cobalt, Raney-iron, Urusibara-nickel, Urusibara-cobalt, etc.; the said heavy metal on carrier e.g. palladium-carbon, nickel-diatomite, etc., and the like.

Suitable solvents utilizable for the catalytic reduction include, for example, an alcoholic solvent e.g. methanol, ethanol, propanol, etc.; other unreductive organic solvent e.g. cyclohexane, tetrahydrofuran, etc. and the like. The catalytic reduction can be further carried out in the molten state without solvent. The reaction temperature and pressure can be properly decided according to the utilized reduction catalyst. For example, in the case of nickel-diatomite or Raney-nickel, the hydrogenation reaction was carried out by heating at 140°–180°C for one to 8 hours under the pressure between 10–200Kg/cm² with hydrogen gas. According to catalytic reduction, double bond is almostly hydrogenated as well as cyano group, though that of cyclohexene ring is not hydrogenated when the reaction is carried out in the presence of a catalyst selected from the group consisting of cobalt, cupper, palladium carbon, etc.

While, it is well known that the secondary amine may be simultaneously produced as a by-product in the hydrogenation reaction of cyano group. Therefore, it is recommendable to conduct the reaction in the presence of ammonia to avoid the proceeding of side reaction in the present invention. Otherwise, it is also recommendable to conduct the reaction with the specific catalyst such as Raney-nickel or Raney-cobalt and with the basic promoter such as sodium acetate in the presence of acetic anhydride, or to complete the reaction within an earlier stage.

An alicyclic amino compound(I) of the present invention is manufactured from abundunt but unutilized materials such as thermal cracking products of petroleum naphtha or coal(e.g. DCPD or its analogous compound) and is a liquid or resinous material.

The said compound has a more exellent affinity with other chemical materials in comparison with various higher fatty amines. Further, the said compound is not absorbed in the bodies of a human, a cattle and a fish, and is not stimulant for those skins. Furthermore, the said compound is non-volatile. Therefore, an alicyclic amino compound(I) is manageable and utilizable as a cationic surface active agent for several uses as described below.

A. An acid salt of an organic acid or a mineral acid such as acetic acid, hydrochloric acid, etc.

The salt is so-called a cationic soap and is utilizable as an emulsifying agent of an emulsion added in a latex, a printing ink, a pigment, etc.; a floatation agent; a sizing agent; an emulsifying agent in emulsion polymerization and the like.

The said cationic soap has an excellent wettability and an affinity with various chemical materials as well as a satisfactory emulsifying effect and a washing effect.

Therefore, the cationic soap exhibits superior properties and characteristics to a fatty amine cationic soap. While, HLB of the cationic soap can be adjusted to the most suitable value as mentioned above. Accordingly, the said soap is utilizable as an emulsifying agent in emulsion polymerization.

B. A complex with pentachlorophenol, cupper acetate or sodium disulfide, etc.

The complex is utilizable as an antifungal agent and an insecticide in several kinds of detergent and the like.

The antifungal effect of the complex is superior to that of the general fatty amine. The detergent can be safely used without any harmful for a human and a food.

C. A quaternary ammonium salt of aralkyl chloride, alkyl chloride or alkylene oxide such as benzylchloride, propylchloride, ethylene oxide, propylene oxide, etc.

The quaternary ammonium salt is utilizable as an insecticide in several kinds of detergents.

D. An aminoalkyl derivative such as an aminopropyl derivative which is obtained by cyanoethylation of aminoalkyl group in the alicyclic amino compound(I) and then by reduction to change the cyanoethylaminoethyl group to an aminopropylaminomethyl group.

The aminoalkyl derivative is utilizable as an emulsifying agent for an asphalt emulsion; an anti-stripping agent; anti-corrosive agent and the like.

The aminoalkyl derivative is stable and when it is utilized as an emulsifying agent of an asphalt emulsion, pavement works are easily conducted with a good job requirement and an adhesive property between an asphalt and an aggregate is quite satisfactory. The aminoalkyl derivative is further utilizable as an anticorrosive agent which has a good affinity with a material to be protected. Accordingly, it is expected to exhibit a strong anti-corrosive effect during a long term.

E. A polyethylene glycolate derivative which is obtained by reacting the alicyclic amino compound (I) with polyalkylene oxide such as polyethylene oxide, polypropylene oxide, etc.

The polyethylene glycolate derivative is utilizable as an anti-corrosive agent, an anti-static agent, a detergent, a lubricant, a dying assistant and the like.

When the polyethylene glycolate derivative is used as an anti-corrosive, it exhibits an excellent absorption ability on a metal surface and an excellent affinity with another anti-corrosive used along with.

Examples of the present invention are given below for a better understanding of the present invention, in which all percentages and parts are by weight.

EXAMPLE 1

In an autoclave were charged 530g of acrylonitrile and 1,320g of DCPD, the resultant mixture was heated at 180°–200°C for 6 hours with stirring. After the reaction was over, the reaction mixture was subjected to distillation to remove the low boiling point distillate at 180°C under an atmospheric pressure and the residue was further subjected to distillation. Five hundred and thirty grams of the first distillate were obtained up to 130°C/6mmHg and then 840g of the second distillate was obtained between the temperature of 131°C/6mmHg and 150°C/5mmHg and further 200g of the third distillate was obtained between the temperature of 151°C/5mmHg and 180°C/1mmHg. The first distillate was a colorless and transparent liquid having a molecular weight of 120. The results of elementary analysis and IR spectrum shown that the first distillate was 5-cyanobicyclo[2,2,1]heptene-2. The second distillate was a colorless and transparent liquid having a molecular weight of 185. The liquid was crystallined with standing. The result of IR spectrum shown that the crystal was 1,2,3,4,4a,5,8,8a-octahydro-2-cyano-1,4-methano-5,8-methanonaphthalene having a melting point of 60°C. The third distillate was cristallined immediately after distillation. The resulting white crystal had a molecular weight of 250 and a melting point of 160°C. The result of IR spectrum shown that the crystal was 1,2,3,4,4a,5,5a,6,9,9a,10,10a-dodecahydro-2-cyano-1,4-methano-5,10-methano-6,9-methanoanthracene.

Thus obtained each distillate was respectively heated at 170°–180°C for 24 hours while isporene was blown little by little with stirring. Then unreacted materials were distilled off to obtain the corresponding additional compound. A molecular weight, and acid value of the corresponding carboxylic acid and a chemical formula of each distillate were shown in Table 1 considering from the results of elementary analysis, IR spectrum and NMR spectrum.

Table 1

| | (1) The first distillate | (2) The second distillate | (3) The third distillate |
|---|---|---|---|
| A number average molecular weight | 190 | 250 | 320 |
| An acid value of the corresponding carboxylic acid | 280 | 195 | 160 |
| Chemical formula | 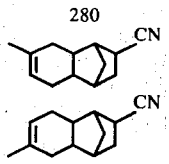 | 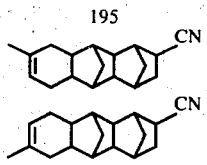 | 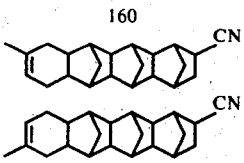 |

Table 1-continued

| | (1) The first distillate | (2) The second distillate | (3) The third distillate |
|---|---|---|---|
| An appearance | liquid | balsam | resin |

Thus obtained each additional product was respectively hydrogenated as follows. In an autoclave were charged 100g of cyano compound, 100g of methanol and 2g of Raney-nickel catalyst. After the air in the autoclave was displaced with hydrogen gas, 40g of liquid ammonia was charged, and then the resultant mixture was subjected to reaction at 160°C for 4 hours with stirring under the pressure of 200Kg/cm$^2$ with hydrogen gas. After the reaction was over, the catalyst was filtered off, and then methanol was distilled off to obtain each 98–100g of the corresponding amino compound as shown as in Table-2.

Table 2

| | (1) | (2) | (3) |
|---|---|---|---|
| A number average molecular weight | 200 | 260 | 330 |
| A primary amine value | 277 | 210 | 167 |
| Chemical structures of a main component | 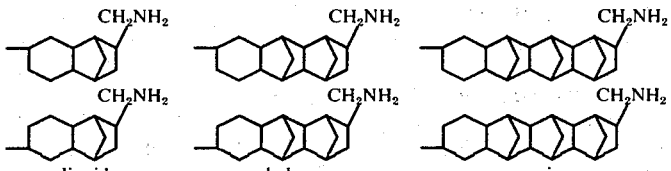 | | |
| An appearance | liquid | balsam | resin |

EXAMPLE 2

To 1190g of 5-cyanobicyclo[2,2,1]heptene-2 which was reacted at 170°–180°C with stirring, 500g of DCPD was added dropwise over 5 hours, then the resultant mixture was subjected to distillation to remove low boiling point materials up to 130°C/60mmHg, whereby, 340g of a pale yellowish liquid was obtained as a residue. Pentadiene-1,3 was blown little by little over 30 hours to the said liquid which was heated at 170°–180°C with stirring. Then the reaction mixture was subjected to distillation to remove low boiling point materials up to 150°C/5mmHg, whereby, a mixture of 1,2,3,4,4a,5,5a,6,9,9a,10,10a-dodecahydro-2-cyano-9-methyl-1,4-methano-5,10-methanoanthracene and 1,2,3,4,4a,5,5a,6,9,9a,10,10a-dodecahydro-2-cyano-6-methyl-1,4-methano-5,10-methanoanthracene was obtained as a residue.

In an autoclave were charged 100g of the said mixture and 2g of Raney-nickel. After the air in the autoclave was displaced with hydrogen gas, 40g of liquid ammonia was charged, and then the resultant mixture was heated at 160°–170°C for 4 hours with stirring under the pressure of 200Kg/cm$^2$ with hydrogen gas. Thereafter, the catalyst in the reaction mixture was filtered off to obtain 100g of the corresponding amino compound being a yellowish viscous liquid. Thus obtained amino compound had a number average molecular weight of 270, a primary amine value of 202. The amino compound was found to be a mixture of perhydro-2-aminomethyl-9-methyl-1,4-methano-5,10-methanoanthracene and perhydro-2-aminomethyl-6-methyl-1,4-methano-5,10-methanoanthracene.

EXAMPLE 3

5,6-Dicyanobicyclo[2,2,1]heptene-2, DCPD and isoprene were reacted in the same way as in Example 2 to prepare 1,2,3,4,4a,5,5a,6,9,9a,10,10a-dodecahydro-2,3-dicyano-7-methyl-1,4-methano-5,10-methanoanthracene as a main product. To 100g of thus obtained mixture, 5g of nickel-diatomite and 40g of liquid ammonia were added, and then the resultant mixture was subjected to hydrogenation at 200°C for 6 hours under 250Kg/cm$^2$ with hydrogen gas. Thereafter, the catalyst in the reaction mixture was filtered off, and a small amount of decomposed materials was distilled off to obtain 85g of a brown resin which included perhydro-2,3-diaminomethyl-7-methyl-1,4-methano-5,10-methanoanthracene as main products.

Each amino compound obtained in Example 1 to 3 was examined as follows.

EXAMPLE 4

Each amino compound(3.5 parts), carnauba wax(35 parts) and 10% aqueous solution of acetic acid(7 parts) were added to water(54.5 parts) to prepare an emulsion respectively. Thus obtained emulsion exhibited a sufficient affinity with a printing ink, a floatation agent and a pigment. Further, the said emulsion exhibited a sufficient effect in emulsion polymerization for producton of styrene polymer as follows.

The emulsifying agent (2.5 parts), which was prepared by dispersing each amino compound obtained in Example 1 to 3 into 10% aqueous solution of acetic acid, was added to a polymerization reaction system including the mixture of styrene(100 parts), pure water(200 parts), azobisisobutylonitrile(0.1 part) and ferrous sulfate(0.05 parts).

Then, polymerization reaction was carried out at 60°C. Each amino compound obtained in Example 1 to 3 could give a stable emulsion as well as rosin amine.

The second and third distillate obtained in Example 1 and the amino compound obtained in Example 2 shown about polymerization degree of 90% after 2 hours.

EXAMPLE 5

Each amino compound obtained in Example 1 to 3 was reacted with pentachlorophenol to give the corresponding complex. An antifungal effect of the complex was examined respectively. Each complex (2 %) was added in an oil paint, and kept in a humid place for one year to observe an occurrence of mold. Every oil paint which was added with the said antifungal agent was not got mildewed, though an oil paint without an antifungal agent was got mildewed after 6 months, and an oil paint which was added with a beef tallow amine was got mildewed after one year.

The amino compound obtained in Example 1 and 3 were not got mildewed in the relative humidity of 95%.

EXAMPLE 6

An acetic acid salt(2%) of each amino compound obtained in Example 1 to 3 was respectively added in a pulp slurry, then a calcium carbonate paper was prepared in the conventional method. An aqueous ink did not blot on the said paper.

EXAMPLE 7

Each amino compound obtained in Example 1 to 3, Rosin amine-D(Hercules Inc. in U.S.A.) and beef tallow amine were reacted with ethylene oxide in the conventional method to obtain the corresponding polyethylene glycolate.

A steel plate was treated with thus obtained polyethylene glycolate to prevent a corrosion. The steel plate was examined for the degree of corrosion by each 2%, 6% and 12% of hydrochloric acid aqueous solution at 70°C. The shickness of the corroded steel during one hour was shown in Table 3.

Table 3

| Concn. of hydrochloric acid aqueous solution | | (unit: μ) 2% | 6% | 12% |
|---|---|---|---|---|
| Amino compound | | | | |
| Example 1 | (1st distillate) | 0.35 | 0.78 | 1.28 |
| | (2nd distillate) | 0.09 | 0.14 | 0.27 |
| | (3rd distillate) | 0.07 | 0.11 | 0.26 |
| Example 2 | | 0.11 | 0.16 | 0.36 |
| Example 3 | | 0.25 | 0.54 | 0.81 |
| Rosin amine-D | | 0.10 | 0.15 | 0.30 |
| Beef tallow amine | | 0.66 | 0.90 | 1.42 |
| Nothing | | 13.5 | 19.9 | 27.0 |

EXAMPLE 8

To 260g of the amino compound(a number average molecular weight: 260, a primary amine value: 210) obtained from the second distillate in Example 1, 159g of acrylonitrile and 0.3g of sodium hydroxide were added, and then the resultant mixture was heated at 70°–75°C for 3 hours with stirring. After the reaction was over, the reaction mixture was heated under reduced pressure to remove the unreacted acrylonitrile, whereby 297g of the corresponding cyanoethylamino compound were obtained as a yellowish balsamic material. In an autoclave were charged 297g of thus obtained cyanoethyl compound and 6g of Raney-nickel. After the air in the autoclave was displaced with nitrogen gas, 80g of liquid ammonia was charged in the autoclave, and then the resultant mixture was heated at 130°C for 4 hours under the pressure of 60Kg/cm$^2$ with hydrogen gas. Thereafter, the hydrogen gas and ammonia gas were discharged, and the catalyst in the reaction mixture was filtered off under heating and pressure to obtain 290g of a yellowish and viscous liquid. The liquid was a mixture of perhydro-2-aminopropylaminomethyl-6-methyl-1,4-methano-5,10-methanoanthracene and perhydro-2-aminopropylaminomethyl-7-methyl-1,4-methano-5,10-methanoanthracene(abbreviated as a mixed diamine hereinafter) having a total amine value of 340 and a partial amine value of 167.

Then, the mixed diamine was examined as an emulsifying agent for an asphalt emulsion and as an antistripping agent for an asphalt and an aggregate. For the sake of contrast, a stearylpropylenediamine and dihydroabietylpropylenediamine obtained from each stearylamine and rosin amine in the same method as described above, were respectively examined.

A hundred grams of straight asphalt(paraffine base: Fuji Kosan Co., Ltd. in Japan, penetration was 80–100) and 0.3g of the said diamine were mixed and heated at 120°C. The resultant mixture was kept for 5, 10 and 24 hours at 180°C. Five frams of the treated asphalt were added to 100g of broken stones (all of them pass through a standard ¾ inches screen and not more than 5% will pass through a ¼ inch screen, collected in Takarazuka city, Japan) which was dried over at 130°C for 3 hours after washing. The resultant mixture was mixed at 130°C for 3 minutes with a bamboo spatula in a 200ml stainless-made beaker, whereby the surface of the stone was coated with the asphalt. After cooling on a glass plate, the coated stone was dipped in hot water of 80°C for 30 minutes to strip the asphalt from the surface of the stone. The stripping rate(%) was shown in Table 4.

Table 4

| Heat treating time (at 180°C) | Stripping rate(%) 0 | 5 | 10 | 24 (hours) |
|---|---|---|---|---|
| Mixed diamine of the present invention | 0 | 0 | 9 | 19 |
| Stearylpropylene-diamine | 0 | 0 | 14 | 25 |
| Dihydroabietylpropylene-dimaine | 0 | 0 | 12 | 22 |
| Nothing | 60 | 70 | 80 | 85 |

One gram of the said each diamine was added to 150g of water, and hydrochloric acid was added to adjust pH to 2.0. The diamine was dissolved in water. Further, 0.3g of calcium chloride was dissolved in the solution to prepare an emulsifying agent solution. The solution was maintained at 60°C in a 500ml stainless-made flask. In the flask, 183g of molten straight asphalt at 120°–130°C (paraffin base: Fuji Kosan Co., Ltd. Japan, penetration was 150–200) was charged and the mixed material was emulsified by a homoginizer to obtain the asphalt emulsion. Storage stability for asphalt emulsion was examined according to the method autholized as JIS-K-2208(Japanese Industrial Standard) as follows.

The asphalt emulsion was maintained at room temperature for 5 days in a 250ml messcylinder. Thereafter, each 50 g of the emulsion was respectively picked out from upper layer and lower layer. The difference of non-volatile component percentage between the each layer was considered as a storage stability as shown as in Table 5.

Table 5

| Emulsifing agent | Storage stability | Englar viscosity |
|---|---|---|
| Mixed diamine of the present invention | 2.3 | 3.8 |
| Stearylpropylne-diamine | 2.4 | 3.6 |
| Dihydroabietyl-propylenediamine | 2.6 | 3.8 |

What is claimed is:

1. An alicyclic amino compound of the general formula:

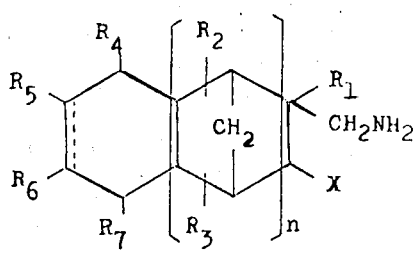

wherein $R_1$, $R_2$, $R_3$, $R_4$, $R_5$, $R_6$ and $R_7$ are each hydrogen, alkyl having 1 to 6 carbon atoms or phenyl; X is each hydrogen, alkyl having 1 to 6 carbon atoms or aminomethyl; *n* is an integer of 1 to 3; position indicated by a dotted line indicates the optional presence of a double bond.

2. The saturated alicyclic amino compound claimed in claim 1 wherein one of $R_4$, $R_5$, $R_6$ and $R_7$ is methyl and others are hydrogen; X, $R_1$, $R_2$, and $R_3$ are each hydrogen; *n* is 1.

3. The saturated alicyclic amino compound claimed in claim 1 wherein one of $R_4$, $R_5$, $R_6$ and $R_7$ is methyl and others are hydrogen; X, $R_1$, $R_2$ and $R_3$ are each hydrogen; *n* is 2.

4. The saturated alicyclic amino compound claimed in claim 1 wherein one of $R_4$, $R_5$, $R_6$ and $R_7$ is methyl and others are hydrogen; X, $R_1$, $R_2$ and $R_3$ are each hydrogen; *n* is 3.

5. The saturated alicyclic amino compound claimed in claim 1 wherein one of $R_4$, $R_5$, $R_6$ and $R_7$ is methyl and others are hydrogen; $R_1$, $R_2$ and $R_3$ are each hydrogen, X is aminomethyl; *n* is 2.

6. A process for producing an alicyclic amino compound of the general formula:

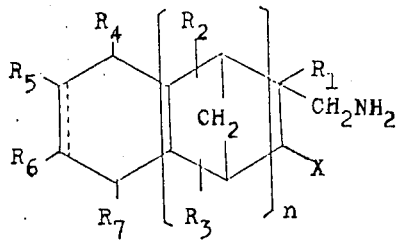

wherein $R_1$, $R_2$, $R_3$, $R_4$, $R_5$, $R_6$ and $R_7$ are each hydrogen, alkyl having 1 to 6 carbon atoms or phenyl; X is each hydrogen, alkyl having 1 to 6 carbon atoms or aminomethyl; *n* is an integer of 1 to 3; and the position indicated by a dotted line indicates the optional presence of a double bond, which is characterized by hydrogenating an alicyclic cyano compound of the general formula:

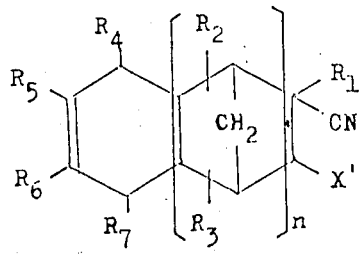

wherein $R_1$, $R_2$, $R_3$, $R_4$, $R_5$, $R_6$, $R_7$ and *n* are each as defined above; X′ is each hydrogen, alkyl having 1 to 6 carbon atoms, aminomethyl or cyano.

* * * * *